US006390068B1

(12) United States Patent
Hartke et al.

(10) Patent No.: US 6,390,068 B1
(45) Date of Patent: May 21, 2002

(54) METHOD FOR MONITORING AN INJECTION SYSTEM

(75) Inventors: Andreas Hartke, Munich; Klaus Wenzlawski, Nuremburg; Achim Przymusinski, Regensburg; Detlev Schoeppe, Wenzenbach, all of (DE)

(73) Assignee: Siemens Aktiengesellschaft (DE)

( * ) Notice: Subject to any disclaimer, the term of this patent is extended or adjusted under 35 U.S.C. 154(b) by 0 days.

(21) Appl. No.: 09/509,457

(22) PCT Filed: Sep. 23, 1998

(86) PCT No.: PCT/DE98/02841

§ 371 (c)(1),
(2), (4) Date: Aug. 7, 2000

(87) PCT Pub. No.: WO99/17010

PCT Pub. Date: Apr. 8, 1999

(30) Foreign Application Priority Data

Sep. 29, 1997 (DE) ..... 197 42 991

(51) Int. Cl.[7] ..... F02M 51/00
(52) U.S. Cl. ..... 123/479; 123/435
(58) Field of Search ..... 123/435, 436, 123/479; 73/117.3, 119 A

(56) References Cited

U.S. PATENT DOCUMENTS 5,386,367 A * 1/1995 Ziegler et al. ..... 123/435
5,687,694 A * 11/1997 Kanno ..... 123/479
5,934,256 A * 8/1999 Wenzalawski et al. ..... 123/479
6,189,524 B1 * 2/2001 Zhang et al. ..... 123/479
6,196,184 B1 * 3/2001 Przymusinski et al. ..... 123/435

FOREIGN PATENT DOCUMENTS

| | | |
|---|---|---|
| DE | 41 39 244 | 11/1991 |
| DE | 196 12 180 | 3/1996 |
| DE | 195 48 279 | 4/1997 |
| EP | 326 898 | 8/1989 |
| EP | 785 349 | 7/1997 |

OTHER PUBLICATIONS

A. Masaharu, "Detecting Device of Knocking in Internal Combustion Engine", Patent Abstracts of Japan, vol. 5, No. 126 (P–075).

* cited by examiner

*Primary Examiner*—John Kwon

(57) ABSTRACT

The energy conversion during a combustion process is computed from the body sound signal of the internal combustion engine according to a theoretical model, and from it the amount of fuel delivered is derived. If the computed amount of fuel differs from the predetermined amount of fuel, a malfunction of the fuel injection system is recognized.

12 Claims, 7 Drawing Sheets

METHOD FOR MONITORING AN INJECTION SYSTEM

FIELD OF THE INVENTION

The invention describes a method for monitoring a fuel injection system in which a body sound signal is detected and used for evaluating the fuel injection system.

In DE 195 48 279 A1 a method and an apparatus are disclosed for monitoring a fuel metering system in which a fault in the metering system is recognized whenever a signal put out by a body sound sensor differs from a set value. The amplitude or the duration of the signal put out by the body sound sensor is compared with a reference signal and, if there is a difference, a defective injection valve is recognized. This method, however, is relatively inaccurate.

The problem to which the invention is addressed is to offer a more accurate method for monitoring a fuel injection system by evaluating the body sound signal.

The stated problem is solved by the features of the independent claims. An important advantage of the invention is that the body sound signal is integrated across a window of measurement, and that the integrated body sound signal is used as a measure of the functionality of the fuel injection system.

Advantageous embodiments and improvements of the invention are given in the dependent claims. The body sound signal is preferably filtered with a given band of frequencies between 1 Hz and 10 kHz. Thus a signal is produced which permits a precise conclusion as to the functionality of the fuel injection system.

The fuel injection system of an internal combustion engine must be monitored for correct operation, especially in the case of high injection pressure.

SUMMARY OF THE INVENTION

The fuel injection system of an internal combustion engine must be monitored for correct operation, especially in the case of high injection pressure.

BRIEF DESCRIPTION OF THE DRAWINGS

The invention will be further explained below with the aid of the drawings, wherein.

DETAILED DESCRIPTION OF THE PREFERRED EMBODIMENT

Figure 1:
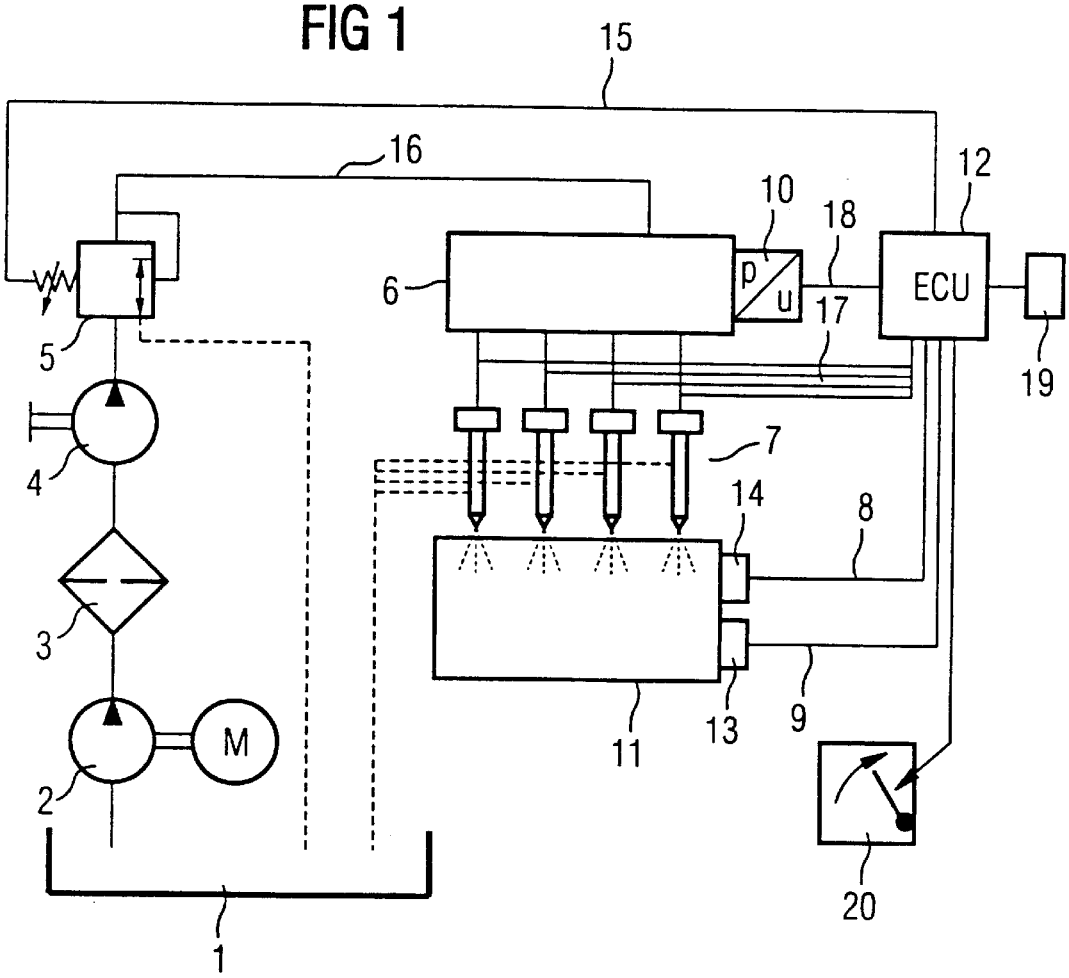
FIG. 1 shows a common-rail fuel injection system.

FIG. 1 shows schematically an injection system for an internal combustion engine.

Fuel is taken from a fuel tank I and fed to a fuel reservoir 6 through a pump 2, a fuel filter 3 and a high-pressure pump 4. The fuel reservoir 6 is connected to injectors 7 which inject the fuel into the internal combustion engine. To adjust the fuel pressure in the fuel reservoir 6, a pressure control valve 5 is connected to a high-pressure line 16 which connects the high-pressure pump 4 with the fuel reservoir 6.

On the fuel reservoir 6 a pressure sensor 10 is disposed, which is connected by a third signal line 18 to a control apparatus 12. Also associated with the internal combustion engine 11 is a body sound sensor 14 and a tachometer 13 which are connected by a first and second signal line to the control apparatus 12. The engine speed sensor 13 is designed as an angular velocity sensor which is composed of a toothed disk and an associated Hall sensor. The control apparatus 12 is also connected by a first control line 15 to the pressure regulating valve 5 and by additional control lines 17 to the injectors 7. Furthermore, the control apparatus 12 is in communication with a data memory 19 in which characteristic curves and control procedures for controlling the injectors and for controlling the pressure control valve 5 are stored. The control apparatus 12 is moreover connected to a gas pedal sensor 20.

The control apparatus 12 controls the fuel pressure in the fuel reservoir 6 and the injection by the injectors 7 in accordance with the gas pedal position and the rotary speed of the internal combustion engine 11 according to the programs deposited in the data memory 19. The control apparatus 12 also uses a process for detecting a defect in the injection system, which is stored in the form of a program in the data memory 19.

Figure 2:
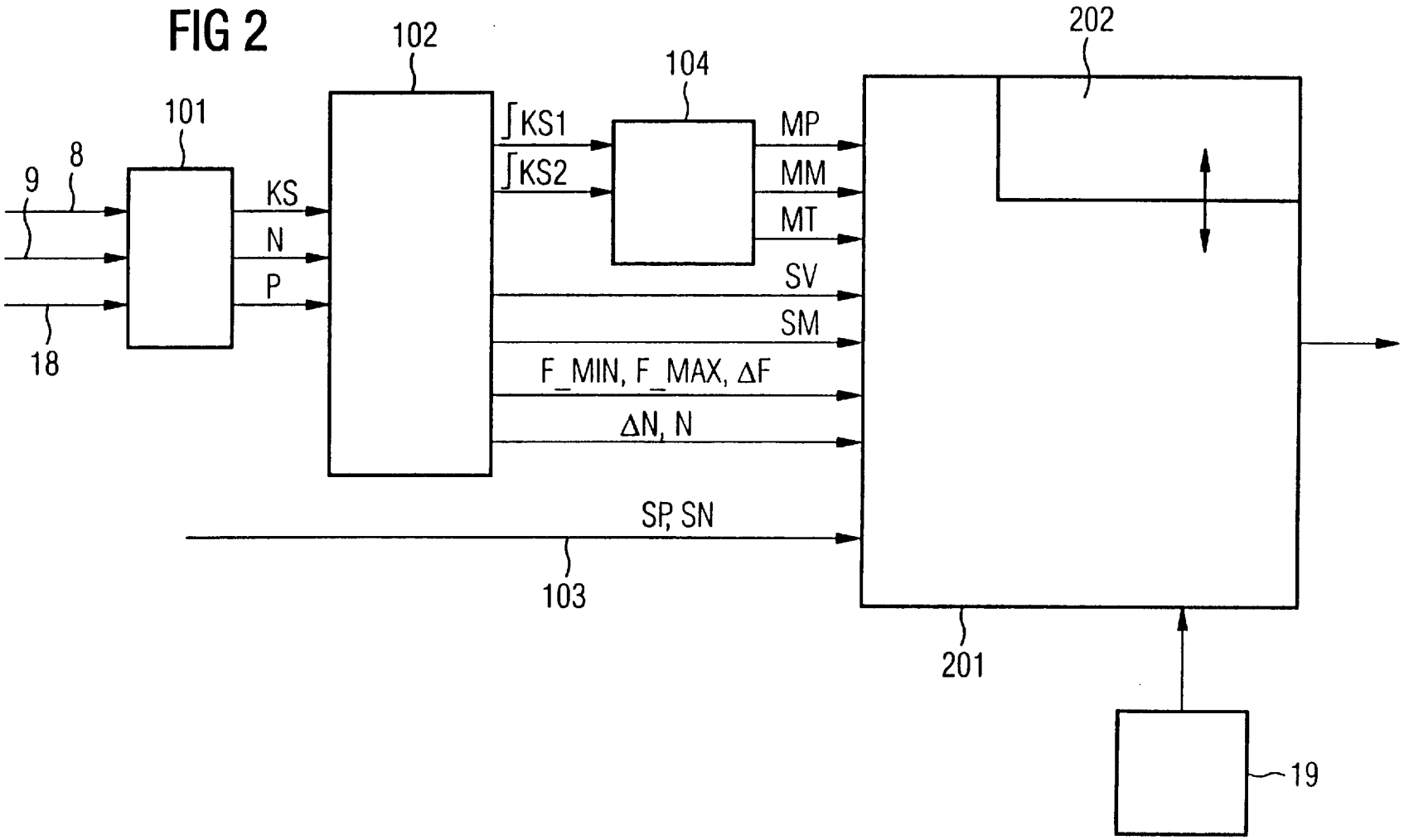
FIG. 2 a block diagram of the signal evaluation.

FIG. 2 shows schematically the construction of the control apparatus 12 with which the process for detecting a defective injection system is performed. The body sound signal is fed through the first signal line 8, the rotary speed signal through the second signal line 9, and the fuel pressure signal through the third signal line 18, to a signal processing unit 101. The body sound signal is filtered in the signal processing unit 101 with a band pass filter, preferably with a second-order Butterworth filter. The frequency range between 1 Hz and 30 kHz, preferably between 10 Hz and 1 kHz, is filtered out of the measured body sound signal and used for the further evaluation.

The band pass filter has preferably the following transfer function $G_r(\sigma)$:

$$\frac{1}{G_r(\sigma): 1 + a_1\sigma + a_2\sigma^2}$$

wherein $\sigma = i\Omega g$ and $\Omega g = w/wg$, wherein wg is a limit angular velocity, w is the angular velocity, $a_1$ is a first factor and $a_2$ is a second factor.

Preferably a band pass filter function is deposited in the data memory 19 for each cylinder of the internal combustion engine 11, so that the body sound signal of each cylinder is filtered preferably with an adapted filter. At the same time the frequency band of the band pass filter is made dependent upon the distance between the body sound sensor and the cylinder, the frequency band being shifted toward lower frequencies as the distance increases.

The frequency band is also preferably deposited in a performance graph related to the rotary speed of the internal combustion engine. The performance graph is determined experimentally by filtering out noises that occur in certain frequency ranges. Preferably the performance graph is adapted individually to each cylinder.

In addition, it is advantageous that the body sound signal for the individual cylinders be selectively amplified, so that the differences arising in the damping due to the different positions of the individual cylinders with respect to the body sound sensor 14 will be compensated. To that end, an amplification factor is deposited in the data memory 19 for each cylinder, by which the body sound signal from the corresponding cylinder will be amplified. Fundamentally, the greater the distance between the cylinder and the body sound sensor is, the greater will be the amplification. In this manner a body sound signal is obtained for all cylinders, which is independent of the position of the cylinders, so that the body sound signals of the cylinders can be compared with one another or compared with a single reference value.

In the signal processing unit 101 a rotary speed signal is derived from the signal of the Hall sensor, by known methods.

The signal processing unit 101 carries the body sound signal KS, the rotary speed signal N and the fuel pressure signal P to an evaluating unit 102. The evaluating unit 102 integrates the body sound signal KS across a first crank angle window F1 and across a second crank angle window F2. The first crank angle window corresponds to the crank angle range of the preliminary injection and the second crank angle window corresponds to the crank angle range of the main injection. The first and the second crank angle window F1 and F2 are given by the control unit 12 and established by the set time at which the injection is to begin, and the set value for the end of the combustion which is dependent on the rotary speed and the amount of fuel injected.

Figure 3:
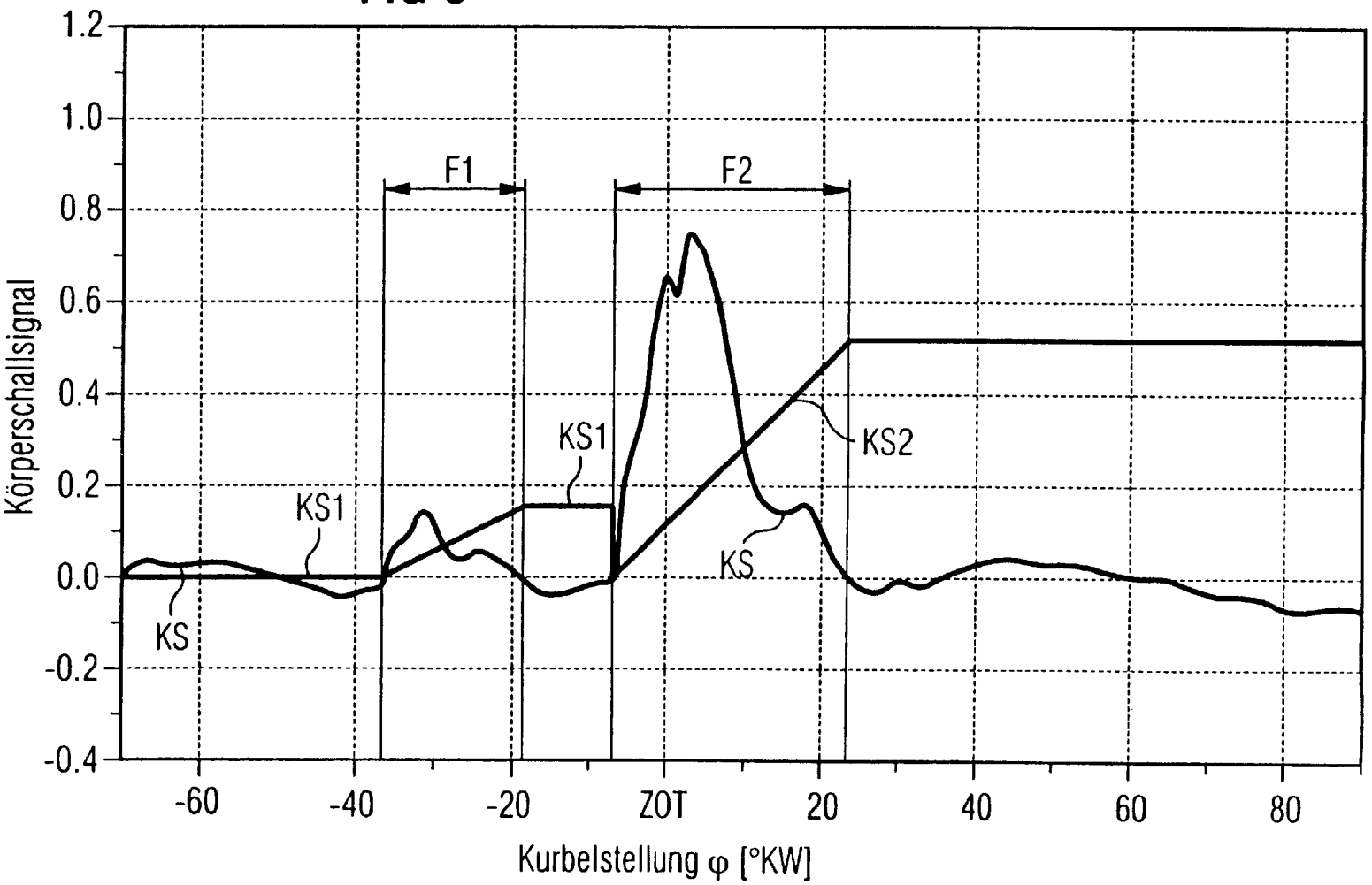
FIG. 3 a body sound signal in relation to the crank angle.

FIG. 3 shows the body sound signal KS supplied to the evaluating unit 102 by the signal processing unit 101, plotted over the crank angle (p of the crankshaft of the internal combustion engine 11. Also represented is the body sound signal KS1 integrated by the evaluating unit 102 for the first crank angle window F1 and the integrated body sound signal KS2 for the second crank angle window F2. The evaluating unit 102 computes the first integrated body sound signal KS1 by the following formula:

$$KS1 = \int_{r1} KS \cdot d\varphi$$

The evaluating unit 102 computes the second integrated body sound signal KS2 by the following formula:

$$KS1 = \int_{r2} KS \cdot d\varphi$$

For a simpler method, instead of the two crank angle windows only one crank angle window is used, which includes the preliminary and the main injection. The body sound signal is then integrated through the preliminary and main injection.

The crank angle at which the energy conversion for the preliminary injection and the energy conversion for the main injection begins are called the first beginning angle SP and second beginning angle SM, respectively.

Figure 4:
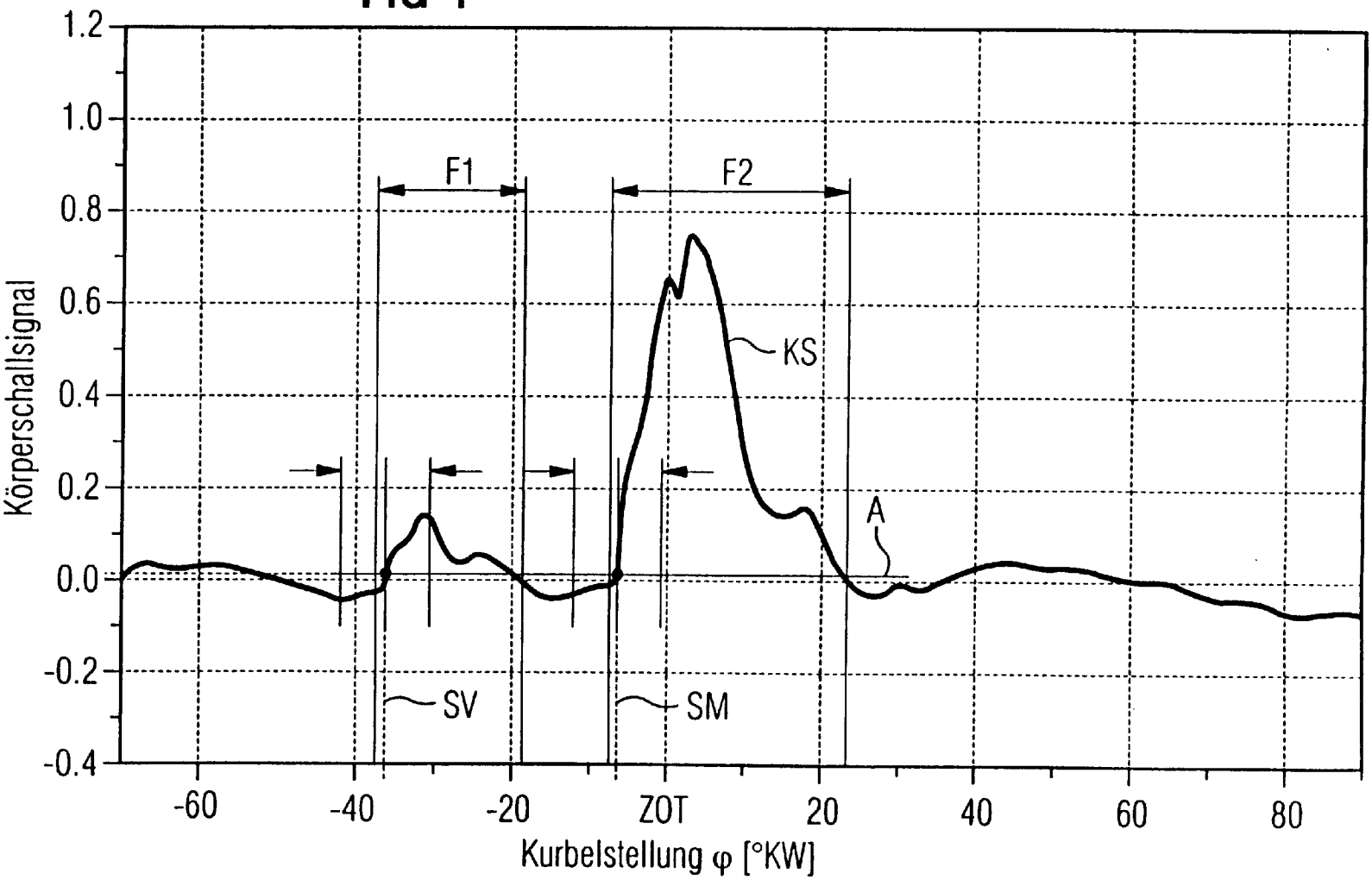
FIG. 4 a body sound signal to indicate the start of the injection.

FIG. 4 shows a process by which the first beginning angle SP and the second beginning angle SM are determined. The body sound signal KS is examined after the beginning of the first crank angle window F1 and after the beginning of the second crank angle window F2 to find the crank angle at which the body sound signal KS reaches a given amplitude value A. This crank angle corresponds to the first and second beginning angles SV, SM, respectively, at which the energy conversion of the preliminary injection and main injection starts.

Figure 5:
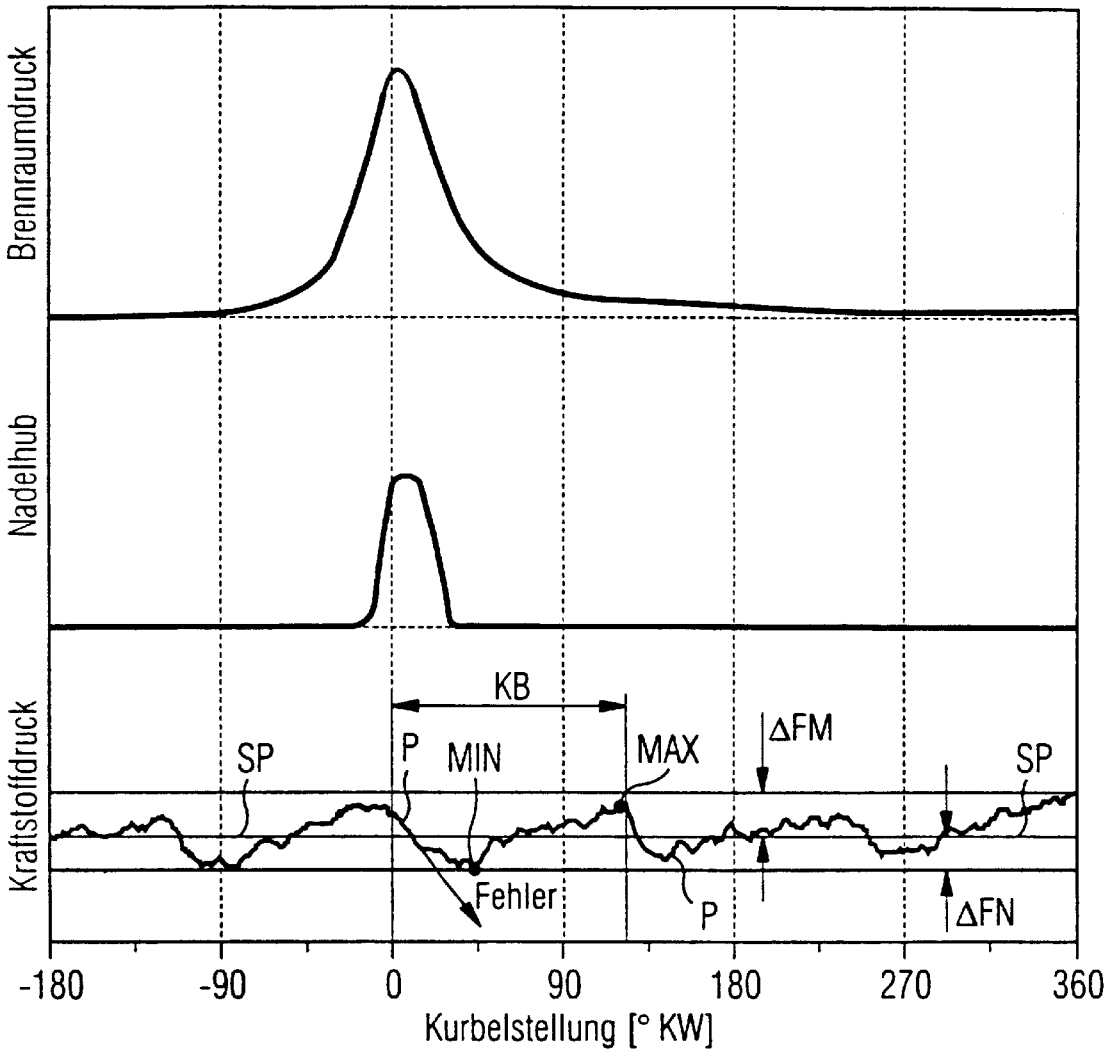
FIG. 5 the fuel pressure in the fuel reservoir in relation to the crank angle, FIG. 6 a revolutions-per-minute signal, and FIG. 7 a flow diagram.

The evaluating unit 102 also learns from the signal of the pressure sensor the minimum fuel pressure F_MIN, the maximum fuel pressure F_MAX and the difference ΔF between the minimum and maximum fuel pressures F_MIN, F_MAX. The process will now be explained with the aid of FIG. 5. FIG. 5 shows the fuel pressure P, the stroke of the injector pintle which opens the injection nozzles, and the combustion chamber pressure over the crank angle for the combustion process of one cylinder. The evaluating unit 102 determines in a given crank angle range KB the minimum fuel pressure F_MIN and the maximum fuel pressure F_MAX. The crank angle range KB is set by the control unit 12 and corresponds to the crank angle range in which fuel is fed to a cylinder for a combustion process.

In addition, the evaluation unit 102 computes the difference ΔF between the maximum and minimum fuel pressure F_MIN, F_MAX within the crank angle range KB by the following formula:

$$\Delta F = F_MAX - F_MIN.$$

In the data memory 19 a set value SP is stored for the fuel pressure in the fuel reservoir 6. Starting out from the set value SP of the fuel pressure, an allowable maximum range ΔFM and an allowable minimum range ΔFN is deposited in the memory 19 for the fuel pressure P.

Figure 6:
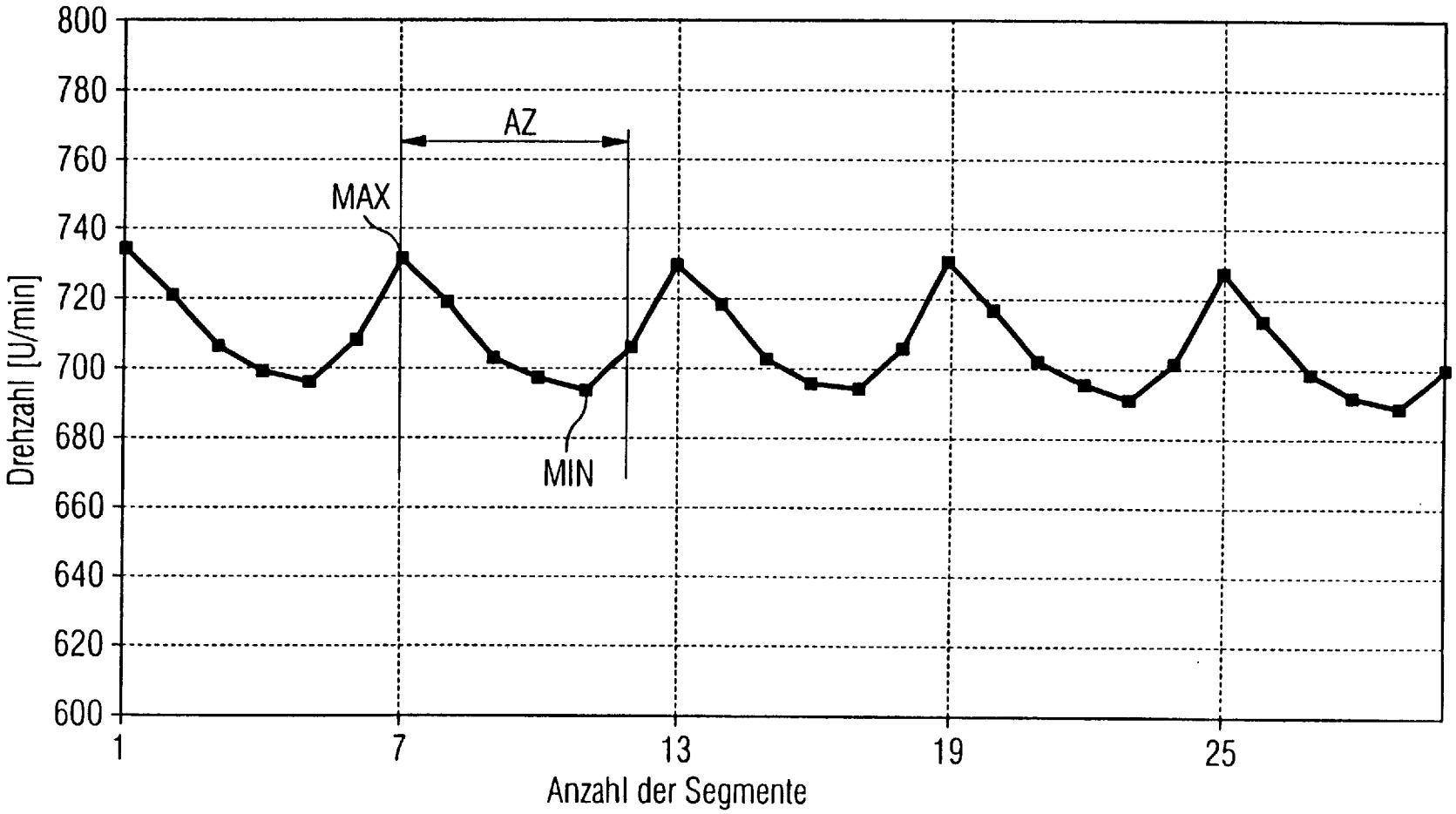

The evaluating unit 102 also evaluates the engine speed signal N of the internal combustion engine 11. At the same time, as represented in FIG. 6, during an analysis period ΔZ the maximum engine speed DX and the minimum speed DN are determined. FIG. 6 shows the engine speed signal across several segments, wherein one segment establishes the crank angle range which one cylinder needs in order to carry out a complete combustion process. One segment amounts, in the case of a four-cylinder motor, to a crank angle range of 720°/4. The segment is set by the control apparatus.

Also, the derivation of the engine speed according to time is made preferably for an analysis period AZ or for each segment. For a more precise evaluation of the engine speed signal N, the time derivative ΔN of the engine speed within one sub-section of a segment is determined, and thus the gradient of the compression speed during compression in the cylinder is determined, or the gradient of the expansion speed during the expansion process in the cylinder.

The evaluation unit 102 forwards the first, integrated body sound signal KS1 and the second integrated body sound signal KS2 to an energy computing unit 104. In a simple embodiment the energy computing unit 104 is omitted and the evaluation unit 102 gives the first and second integrated body sound signal KS1, KS2 directly to the status robot 201. The energy computing unit 104 computes the energy converted in the internal combustion engine 11 according to a theoretical model. The converted energy is preferably made equal to the amount of fuel injected. In the simplest embodiment, the amount of fuel injected is calculated according to a linear approach:

$$MF = C_{MF} \int KS^* d\phi = C_{MF}^* (KS1 + KS2)$$

wherein $_{MF}$ is the amount of fuel, $C_{MF}$ is an integration constant,

KS is the body sound signal,

σ is the crankshaft angle,

KS1 is the first integrated body sound signal and

KS2 the second integrated body sound signal. The integration is performed through the first and the second crankshaft angle window F1 and F2.

The integration constant $C_{MF}$ is determined experimentally. Preferably the integration constant $C_{MF}$ is recorded as a characteristic depending on the engine speed and/or depending on the fuel pressure.

The energy calculating unit 104 computes the fuel mass MP injected during a preliminary injection according to the following formula:

$$MP=C_{MF}*\int KS*d\phi=C_{MF}*KS1,$$

the integration being performed through the first crank angle window F1.

The fuel mass MM which was fed to the internal combustion engine 11 during the main injection is computed by the energy calculating unit 104 by the following formula:

$$MM=C_{MF}\int KS*d\phi=C_{MF}*KS2,$$

the integration being performed through the second crank angle window F2.

The total fuel mass MT which is injected into the internal combustion engine 11 during the preliminary injection and during the main injection is computed by the following formula:

$$MT=MP+MM.$$

The evaluating unit 102 gives to the status robot the rotatory speed N, the speed gradient ΔN for each segment, the speed gradient for the analysis period, and the speed gradients during the compression process and during the expansion process, the minimum fuel pressure F_MIN, the maximum fuel pressure F_MAX, the difference ΔF between the minimum and maximum fuel pressure, the first starting angle SV of the preliminary injection, and the second starting angle SM of the main injection.

The energy calculating unit 104 passes to the status robot 201 the preliminary injection amount MP, the main injection amount MM and the total injection amount MT for the combustion processes of the cylinders.

The set values for the preliminary injection amount MP, the main injection amount MM, the total injection amount MT, the injection start SV for the preliminary injection, the injection start SM for the main injection, the set value SP for the fuel pressure in the fuel reservoir 6 and the speed SN of the internal combustion engine 11 are fed to the status robot 201 through the entry interface 103.

In addition, the status robot 201 is connected with the data memory 19 in which allowable ranges of values are stored for the preliminary injection amount ΔMP, the main injection amount ΔMM, and the total injection amount ΔMT. Also, the data memory 19 has allowable ranges ΔSV for the first starting angle SV and allowable ranges ΔSM for the second starting angle SM.

Figure 7:
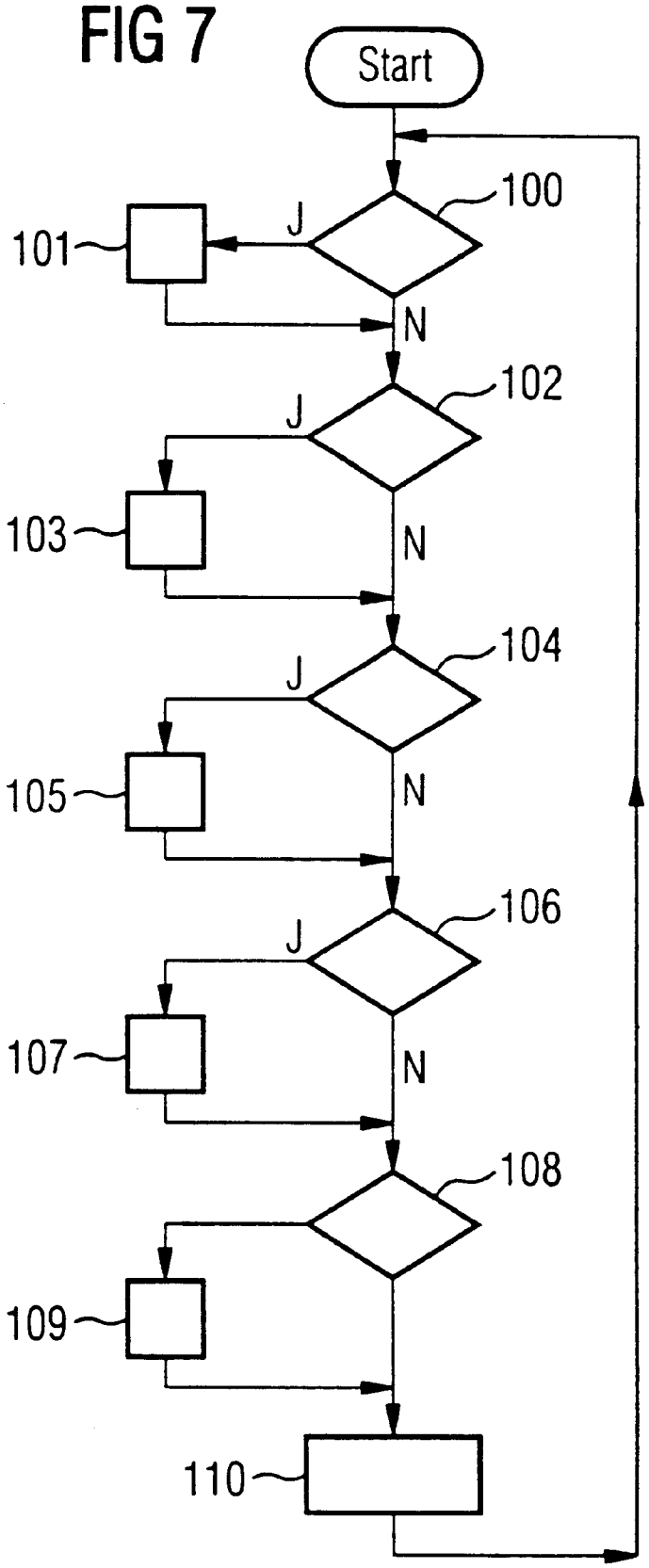

In FIG. 7 there is given a flow diagram by which the status robot 201 checks the operation of the fuel injection system.

After the internal combustion engine starts at program point 100, the total amount of fuel injected MT, computed by the energy calculating unit 104, is compared by the status robot 201 with the allowable range ΔMT of the total injection amount. If the comparison shows that the difference is greater than the given allowable ΔMT range, the robot branches off to program point 101. At program point 101 the status robot records a malfunction of the total injection in the status memory 202.

Preferably, at program point 100, instead of the total injection amount, the status robot 201 compares the preliminary injection amount and/or the main injection amount with corresponding allowable ranges of value. If the comparison shows that the preliminary injection amount detected differs from the corresponding permissible range, a malfunction in the injection system during the preliminary injection is recognized and the robot branches over to program point 101.

If the main injection amount detected differs from the corresponding allowable range of values, a malfunction in the injection system during the main injection is recognized. If the comparison shows that a malfunction has occurred during the preliminary or main injection, then at program point 101 a reference to a malfunction in the main injection or preliminary injection is registered in the status memory 202. Then the status robot moves on to program point 102.

In a simple embodiment, at program point 100, instead of the fuel amount, the body sound signal KS1, KS2, that has been integrated for a combustion process, is compared with a corresponding range of values. If the first and/or second integrated body sound signal KS1, KS2, is outside of the allowable range, then at program point 101 an error record is entered accordingly in the status memory. The allowable value ranges are deposited, for example, in the data memory 19 in relation to the speed and the set amount of fuel.

If the comparison at program point 100 shows there is no malfunction, the program branches to point 102.

At program point 102 the status robot 201 compares the first start angle SV of the preliminary injection, computed by the evaluating unit 102, with a preset allowable range of values. If the comparison shows that the first start angle, i.e., the calculated start of the preliminary injection, is outside of the allowable range, the program branches to program point 103. At program point 103 the status robot 201 enters an error on a malfunction of the preliminary injection in the status memory 202. Then it changes to program point 104.

If the comparison at program point 102 shows that no malfunction is recognized, it changes to program point 104.

At program point 104 the status robot 201 compares the second start angle, i.e., the beginning of the main injection SM computed by the evaluating unit 102, with a given permissible range of values. If the comparison shows that the computed start of the main injection SM is outside of the allowable range of values, the status robot 201 detects a malfunction in the main injection and deposits in the status memory 202 at program point 105 a record of a malfunction at the beginning of the main injection. Then the robot changes to program point 106.

If the comparison at program point 104 does not show any malfunction the robot switches to program point 106.

At program 106, the status robot 201 checks the fuel pressure available in the fuel reservoir 6 for the examined injection process. To do this the status robot 201 compares the minimum fuel pressure F_MIN measured by the evaluation unit 102 with an allowable minimum fuel pressure. Likewise the status robot 201 compares the maximum fuel pressure F_MAX, measured by the evaluation unit 102, with a given maximum fuel pressure.

If the comparison shows that the measured minimum fuel pressure F_MIN or the measured maximum fuel pressure differs from the set value of the fuel pressure by more than a given range of values, a malfunction is recognized in the pressure system of the injection system and the robot branches off to program point 107. At program point 107 an error entry for the pressure system is recorded, in the status memory 202. Then the robot branches to program point 108.

If the comparison at program point 106 shows no malfunction, it branches to program point 108.

At program point 108 the status robot evaluates the speed of the internal combustion engine 11 in order to strike a judgment concerning any malfunction. For this purpose the status robot 201 compares the speed measured by the evaluation unit 102 over an analysis period with a given range of values. If the comparison shows that the measured speed is outside of the allowable range, a malfunction in the injection system is recognized and it branches to program point 109. At program point 109 an error entry is made in the status memory 202 for the speed.

Preferably, the time derivation of the speed for an analysis period is compared with a corresponding allowable range of values, and in case of a departure from the allowable range a malfunction is recognized. Instead of the time derivation of the speed for an analysis period, the time derivation of the speed for a segment can also be compared with a corresponding allowable range of values. If the comparison shows that the time derivation of the speed for a segment is outside of the allowable range of values, a malfunction is recognized for the segment and a corresponding error entry is made in the status memory 202.

An especially accurate judgment of the fuel injection system is achieved by comparing the gradient of the speed in individual segments with a corresponding acceptable range of values. This is done, for example, for a compression process or for an expansion process in a cylinder. If the measured speed gradient is outside of the allowable range of values, a malfunction is recognized in the compression process or in the expansion process.

If the comparison at program point 108 shows that no malfunction exists, then the status robot branches off to program point 110.

The status robot 201 then examines, at program point 110, whether an erroneous entry has been deposited in the status memory 202. If this is the case, a malfunction of the injection system is recognized.

Preferably, the status robot 201 does not recognize a malfunction in the fuel injection system at program point 10 until at least one malfunction has been detected on the basis of the evaluation of the body sound signal, and at least one additional malfunction in the evaluation of the fuel pressure signal, or in the evaluation of the rotatory speed. In this manner erroneous decisions on an error recognition in the injection system are avoided.

Then the status robot returns to program point 100 and the program is restarted after a given period of time.

Preferably an error is not recognized until an error has been detected in several passes through the program. In particular, a debouncing can be arranged, in which only the erroneous entries of four program runs are stored, and an error is recognized only when an error has been recognized in at least two program runs.

An improvement of the process is achieved by using the body sound sensor to detect the background noise of the internal combustion engine in a time period in which no combustion is taking place. In evaluating the body sound signal for a measuring window, the control apparatus subtracts the background noise from the body sound signal measured in the measuring window, so that substantially only the body sound signal produced by combustion is left. In this manner an accurate evaluation of the remaining body sound signal is possible.

What is claimed is:

1. Method for monitoring a fuel injection system of an internal combustion engine in which a body sound signal is detected, wherein the body sound signal is used for evaluating the fuel injection system, characterized in that the body sound signal is integrated across a given measuring window, the integrated body sound signal is used as a measure of the functionality of the fuel injection system, and the measured body sound signal is evaluated with the background noise which the internal combustion engine produces without combustion.

2. Method for monitoring a fuel injection system of an internal combustion engine in which a body sound signal is detected, wherein the body sound signal is used for evaluating the fuel injection system, characterized in that the body sound signal is integrated across a given measuring window, the integrated body sound signal is used as a measure of the functionality of the fuel injection system, and the integrated body sound signal is evaluated with an evaluation factor in order to compute the amount of fuel injected.

3. Method according to claim 1 or 2, characterized in that the body sound signal is filtered with a frequency band of 1 Hz to 10 kHz, especially with a frequency band of 10 Hz to 1 kHz, and that the body sound signal within the frequency band is further processed.

4. Method according to claim 1 or 2, characterized in that the body sound signal is filtered with a Butterworth filter of the Second Order.

5. Method according to claim 2, characterized in that the evaluation factor depends upon at least one of the fuel pressure and the speed of the internal combustion engine during the injection under consideration.

6. Method according to claim 1 or 2, characterized in that the body sound signal is integrated for at least one of a preliminary injection and a main injection, that the integrated body sound signal is compared with standard values, and that the comparison is used in evaluating the fuel injection system.

7. Method according to claim 1 or 2, characterized in that the body sound signal is detected for at least one of a preliminary injection and a main injection, that the injection start of the at least one of the preliminary and main injection is detected from the body sound signal, that the injection start of the at least one of the preliminary and main injection is compared with an allowable range of set values, and that the comparison is used in judging the fuel injection system.

8. Method according to claim 2, characterized in that the amount of fuel injected into the internal combustion engine is computed from the integrated body sound signal, and the computed fuel amount is compared with a fuel amount pre-established for the injection in question, and that the functionality of the fuel injection system is evaluated on the basis of the comparison.

9. Method according to claim 1 or 2, characterized in that in addition to the body sound signal the fuel pressure for the combustion process under consideration is measured, that the measured fuel pressure is compared with an allowable range of values, and that the comparison is used in order to judge the functionality of the fuel injection system.

10. Method according to claim 1 or 2, characterized in that, in addition to the body sound signal, the engine speed signal is measured for the injection process under consideration, that the speed signal is compared with an allowable range of values, and that the comparison is used in judging the functionality of the fuel injection system.

11. Method according to claim 9 or 10, characterized in that any malfunction of the fuel injection system is not recognized until the evaluation of the body sound signal and the evaluation of at least one of the fuel pressure signal and the engine speed signal indicates a malfunction.

12. Method according to claim 11, characterized in that, any malfunction of the fuel injection system is not recognized until the evaluation of the body sound signal and the evaluation of the fuel pressure signal or the evaluation of the body sound signal and the evaluation of the engine speed signal indicate a malfunction.

* * * * *